United States Patent [19]

Struble

[11] 4,267,955

[45] May 19, 1981

[54] QUICKLY ERECTED SCOOP-TYPE CARTON AND LAYOUT FOR CUTTING

[75] Inventor: Glenn E. Struble, Oxford, Ohio

[73] Assignee: Diamond International Corporation, New York, N.Y.

[21] Appl. No.: 60,516

[22] Filed: Jul. 25, 1979

[51] Int. Cl.[3] ..... B65D 5/36; B65D 5/08

[52] U.S. Cl. ..... 229/16 R; 229/1.5 B; 229/41 B

[58] Field of Search ..... 229/1.5 B, 16 R, 37 R, 229/41 B, 41 D, DIG. 9

[56] References Cited

U.S. PATENT DOCUMENTS

| | | | |
|---|---|---|---|
| 2,337,199 | 12/1943 | Holy | 229/16 R X |
| 2,385,898 | 10/1945 | Waters | 229/1.5 X |
| 3,110,433 | 11/1963 | Mosse et al. | 229/DIG. 9 X |
| 3,630,430 | 12/1971 | Struble | 229/41 D X |
| 3,684,157 | 8/1972 | Mendez | 229/16 R |
| 3,877,632 | 4/1975 | Steel | 229/41 B |
| 4,106,688 | 8/1978 | Berger et al. | 229/DIG. 9 X |
| 4,185,764 | 1/1980 | Cote | 229/16 R |

*Primary Examiner*—Davis T. Moorhead
*Attorney, Agent, or Firm*—Karl W. Flocks

[57] ABSTRACT

An improved blank for a scoop-type carton with a layout and method for the cutting of quickly erected scoop-type cartons with a maximum of nested common edges and the remaining edges at a distance exceeding the widths of two cutting knife blades. This is partially obtained by increased use of common edges parallel to the carton center line and the areas on the flaps for gluing.

8 Claims, 7 Drawing Figures

QUICKLY ERECTED SCOOP-TYPE CARTON AND LAYOUT FOR CUTTING

BACKGROUND OF THE INVENTION

The present invention relates to cartons, and more particularly to folding cartons of the type including scored fold lines on the end and bottom wall panels so that they may be expanded readily from flat to setup position and to layouts for cutting out the blanks with the most efficient use of material.

In restaurants, especially of the carryout type there is a need for open end cartons that can be simply and inexpensively manufactured and then can be stored in flattened condition until ready for use. These cartons must then be able to be assembled with the very minimum of effort and time and then serve a dual purpose of scooping up the items and then holding these items until they are consumed.

Such a food item for which the carton of the present invention is most useful is in the serving of french fried potatoes. It has been found most desirable if such a carton could be picked up and be assembled merely by the use of one hand and immediately be used to scoop up the food item and be handed to the customer without further effort or utensils being used.

Since the foot item would of course be spilled and wasted if the box should collapse while being used by the customer it was important that although the carton be easy to assemble, the assembled carton must positively hold its shape and not tend to reassume its flattened position.

Such a carton which has the combined attributes of inexpensive manufacture, quick and easy opening into a positive locked assembled carton, and shaped for scooping was described in applicant's prior U.S. Pat. No. 3,630,430 issued Dec. 28, 1971.

Therefore the present invention relates to a modified form of the carton. The layout of this modified carton allows the cutting of cartons from web or sheet material to obtain more cartons than previously obtainable from equivalent material in prior art quickly erected scoop-type cartons.

SUMMARY OF THE INVENTION

The present invention is directed to a layout for cutting interfitting carton blanks into the individual carton blanks with the blanks shaped to allow close interfitting for additional blanks obtainable per unit of material.

It is an object of the present invention to provide a carton blank configuration to make maximum use of the width of the printing equipment and most economical use of board with the least amount of scrap.

It is a further object of the present invention to maintain the edges parallel to the center line of the carton which are necessary in the gluing operation while obtaining the maximum use of material.

DESCRIPTION OF THE PREFERRED EMBODIMENT

Figure 4:
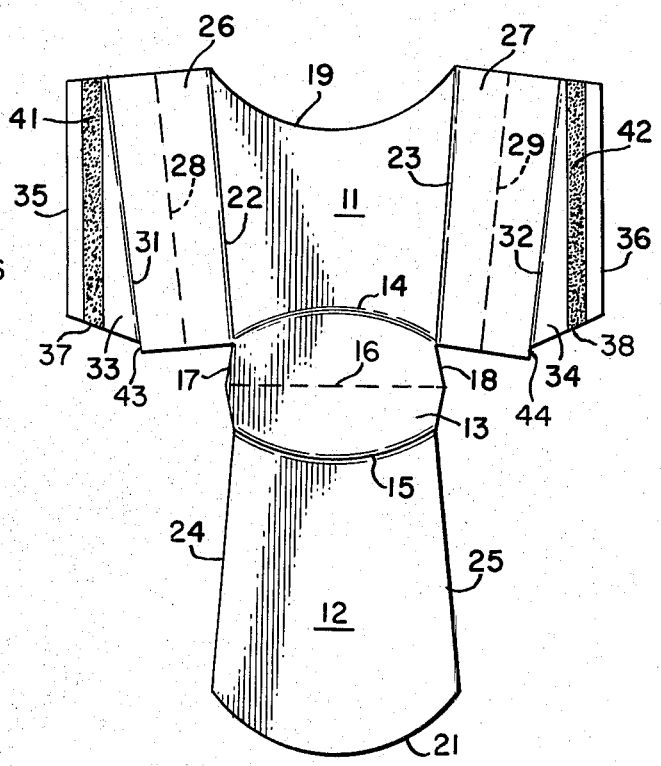
FIG. 4 is a plan view of a blank as found in the prior art for forming a carton of the type illustrated in FIGS. 1–3.

Referring first to FIG. 4, the carton blank of prior art there illustrated includes a pair of sidewall panels 11 and 12 each having a shorter edge attached to opposite sides of a bottom panel 13 along arcuate score lines 14 and 15, respectively. Bottom panel 13 is bisected by score line 16, and the edges 17, 18 of bottom panel 13 which are not connected to side panels 11 and 12 are formed as inwardly sloping from the bisecting score line 16 toward, and connected to the ends of, arcuate score lines 14 and 15.

Arcuate score lines 14 and 15 are curved so as to produce concave edges on side panels 11 and 12, respectively. The opposite edge of sidewall panel 11 is also inwardly curved to form a concave edge 19 to that panel. The form of sidewall panel 12 differs in that its opposite edge is curved outwardly to form a convex edge 21. Sidewall panel 11 has score lines 22 and 23 extending laterally and outwardly tapering between arcuate score line 14 and concavely curved edge 19. Sidewall panel 12 also has outwardly tapering edges 24 and 25 extending from arcuate score line 15 to the ends of convex edge 21. End wall panels 26 and 27 extend laterally along score lines 22 and 23, respectively and are thereby connected to sidewall panel 11. End wall panels 26 and 27 are each bisected by a score line 28 and 29, respectively. Along their opposite lateral edges at score lines 31 and 32, respectively, are attached glue flaps 33 and 34, respectively. Glue flaps 33 and 34 have outer free edges 35 and 36, respectively, which are parallel to each other and which have their bottom edges 37 and 38 respectively forming a beveled edge between the outer free edges 35 and 36 and score lines 31 and 32, respectively. This beveled shape is of a sufficient angle to exceed the angle of the arcuate edge 15 so as not to extend below that arcuate edge when the carton is in a glued, and either folded or extended position.

Glue lines 41 and 42 are substantially parallel to each other and to outer free edges 35 and 36, respectively, of glue flaps 33 and 34 since parallel application of glue on such a blank is much easier, requiring simpler gluing machinery using the technique and equipment customarily used in the folding carton industry.

End wall panels 26 and 27 extend below the intersections of score lines 22 and 23 respectively with score line 14, so as to form legs 43 and 44 respectively which are used to support the erected carton in an upright position.

Figure 5:
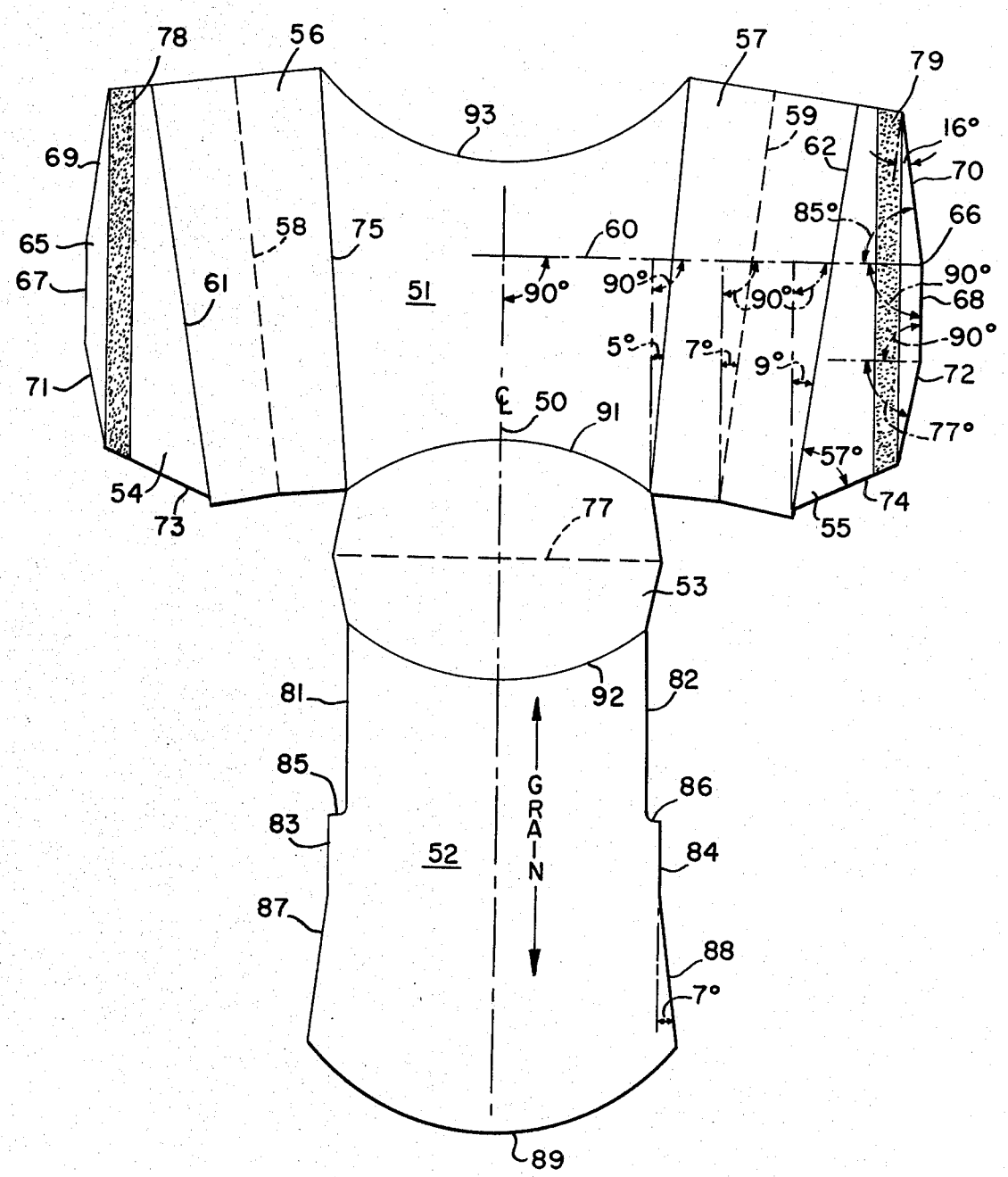
FIG. 5 is an enlarged plan view of a blank in the present invention used to form cartons of the type shown in FIGS. 1–3 in an improved manner.

While FIG. 4 shows a blank of the prior art of the present inventor's patent, this blank has been modified and improved as shown in FIG. 5. Also, although FIGS. 1–3 appear somewhat like the cartons of the same prior art, it should be noted in FIGS. 1 and 2 that the glue flaps and one of the sidewall panels are as formed by the blank of FIG. 5. Thus it can be seen that the carton of this invention has all the advantages of the quickly erected scoop-type carton of the prior art invention and, in addition, has the advantages of better use of material, allowing the cutting of more cartons in the same amount of time, producing of less board scrap per carton, and therefore less cost per carton due to less scrap.

In the carton blank of FIG. 5 sidewall 51, bottom panel 53 and end walls panels 56 and 57 are similar to sidewall 11, bottom panel 13, and end wall panels 26 and 27 with similar shapes and score lines. But remaining portions differ to accomplish the purposes of the invention. Center line 50 has perpendicular line 60 extending therefrom. Outer free edges 65 and 66 of glue flaps 54 and 55 respectively each have three straight portions. Middle portions 67 and 68 are both parallel to center line 50 (perpendicular to perpendicular line 60). Upper portions 69 and 70 connected at the upper portions of portions 67 and 68 respectively extend at an angle of 85° from perpendicular line 60. Lower portions 71 and 72 connected at the lower portions of portions 67 and 68 respectively extend at an angle of 77° from a line parallel to perpendicular line 60. Connecting with lower ends of lower portions 71 and 72 are bottom edges 73 and 74 extending upward from the bottom edges of end wall panels 56 and 57 respectively at angles of 57° from score lines 61 and 62 respectively which score lines extend upward from its lowest point at angles of 9° from lines parallel to center line 50. Similarly score lines 58 and 59 are shown at 7° from lines parallel to center line 50 and lateral edges 75 and 76 at 5° from lines parallel to center line 50.

Sidewall panel 52 is shaped to complement the shapes of glue flaps 54 and 55. Edges 81 and 82 extend downward from bottom panel 53 in lines parallel to center line 50. Middle edge portions 83 and 84 connecting to edges 81 and 82 are also extending parallel to center line 50 with connecting links 85 and 86 between edge 81 and edge portion 83 and between edge 82 and edge portion 84, respectively, shaped so as to indent edges 81 and 82 from edge portions 83 and 84, respectively. Either these edges are indented or links 85 and 86 are sloped inward, or both are spaced, but not angled, from each other. The opposite lower ends of edge portions 83 and 84 are connected to edge portions 87 and 88 which angle at 7° from lines parallel to center line 50 and connect to opposite ends of convex edge 89 of sidewalls panel 52.

It is shown in FIG. 5 that the carton blank is cut in the direction of board grain and although it has been found that the carton will open better when cut in this direction, it is not necessary to cut it in that manner.

Figure 1:
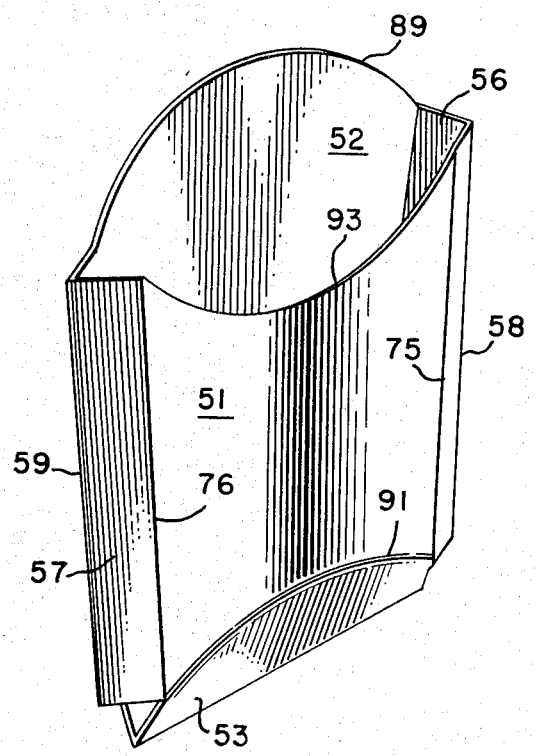
FIG. 1 shows a quickly erected scoop-type carton assembled and in a partially expanded condition.

Referring back to FIGS. 1-3, therein is illustrated the type of quickly erected scoop-type carton formed from the blank of FIG. 4 but more specifically is shown the carton as formed from the blank of FIG. 5, although the appearance difference is minimal. FIG. 1 shows the carton in a partially folded position. This carton which may be formed by conventional folding machinery has been formed by first folding the carton blank along score line 77 and after applying glue lines 78 and 79, then folding the blank along score lines 58 and 59, thereby forming the carton in its closed and flattened position. In this position score lines 75 and 76 lie substantially parallel and immediately adjacent to score lines 61 and 62, respectively.

Figure 2:
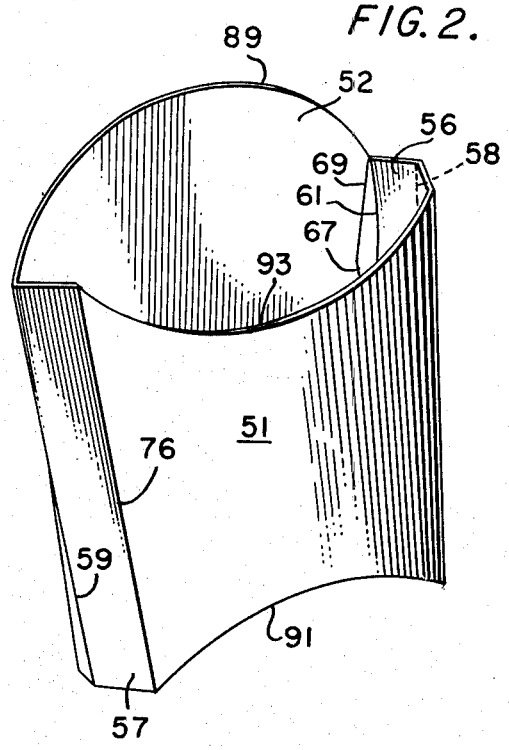
FIG. 2 is a perspective view of the carton of FIG. 1 in setup condition ready for the scooping and insertion of a product therein.
Figure 3:
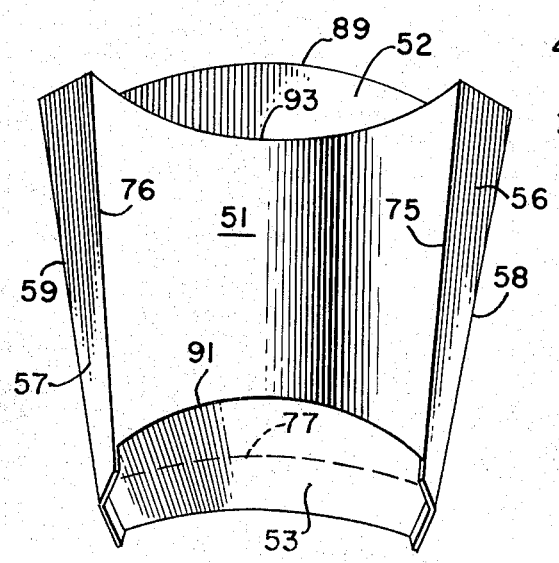
FIG. 3 is another perspective view of the carton of FIGS. 1 and 2 in setup condition, as seen from a side-bottom view.

When the carton is to be used it will be shaped to its useful form as shown in FIGS. 2 and 3. This is easily accomplished by pressing with the fingers along score lines 58, 59 and 77. Due to the arcuate score lines 91 and 92 along bottom panel 53 the carton will be formed in a positive manner so as not to return to the flattened position and thereby spill the contents therein.

It will be noted as clearly illustrated in FIG. 3 that the end panels are tapered outwardly due to the tapered form of the respective edges, 75, 76, 61 and 62. This outward taper in cooperation with the convex edge 89 of sidewall panel 52 and concave edge 93 of sidewall panel 51 form a scoop allowing better use of the carton of the present invention. By having this scoop formed in the manner shown, the carton in its use at food carryout shops allows the scooping up of a serving of french fries or the like without the use of additional utensils to fill the carton, speeding the operation since only one hand is needed for both the forming of the carton and the scooping of the food product into it. Since the picking up of a serving is so easily accomplished such foods may remain in their respective pot or pan and thus be kept hot until immediately before serving to the customer. The positive action keeping the carton open through its use of arcuate score lines allows use of the carton in carryout food shops with less chance of spilling of the contents and easier handling of the carton while eating and consuming its contents. In addition, the convex versus concave shapes in cooperation with each other and the tapered end panels eases the scooping action by providing a wide mouth end for picking up and serving of the food product.

Figure 6:
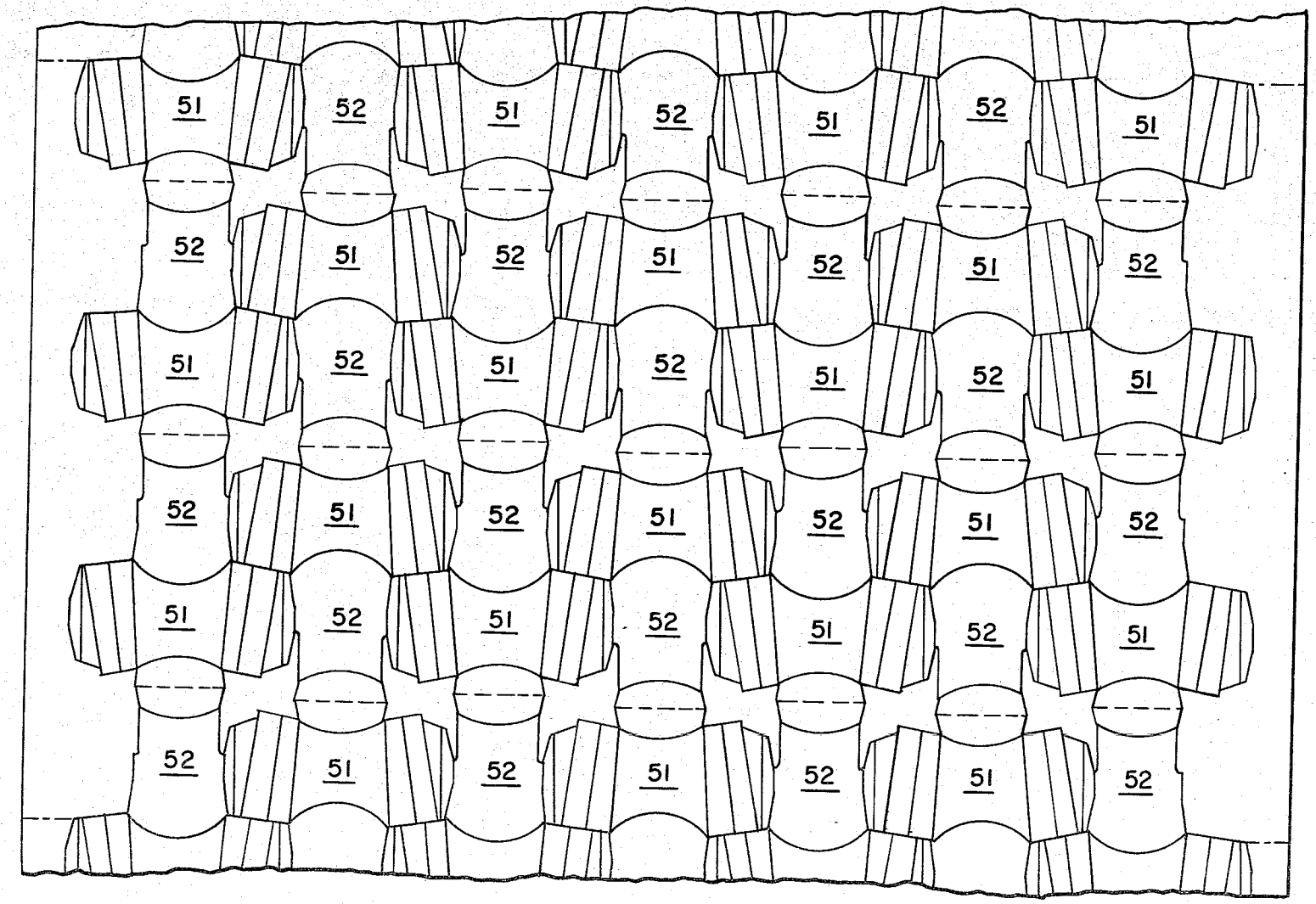
FIG. 6 is a plan view of a sheet or web of material on which the nested relationship of a plurality of the blanks of FIG. 5 is depicted according to this invention.
Figure 7:
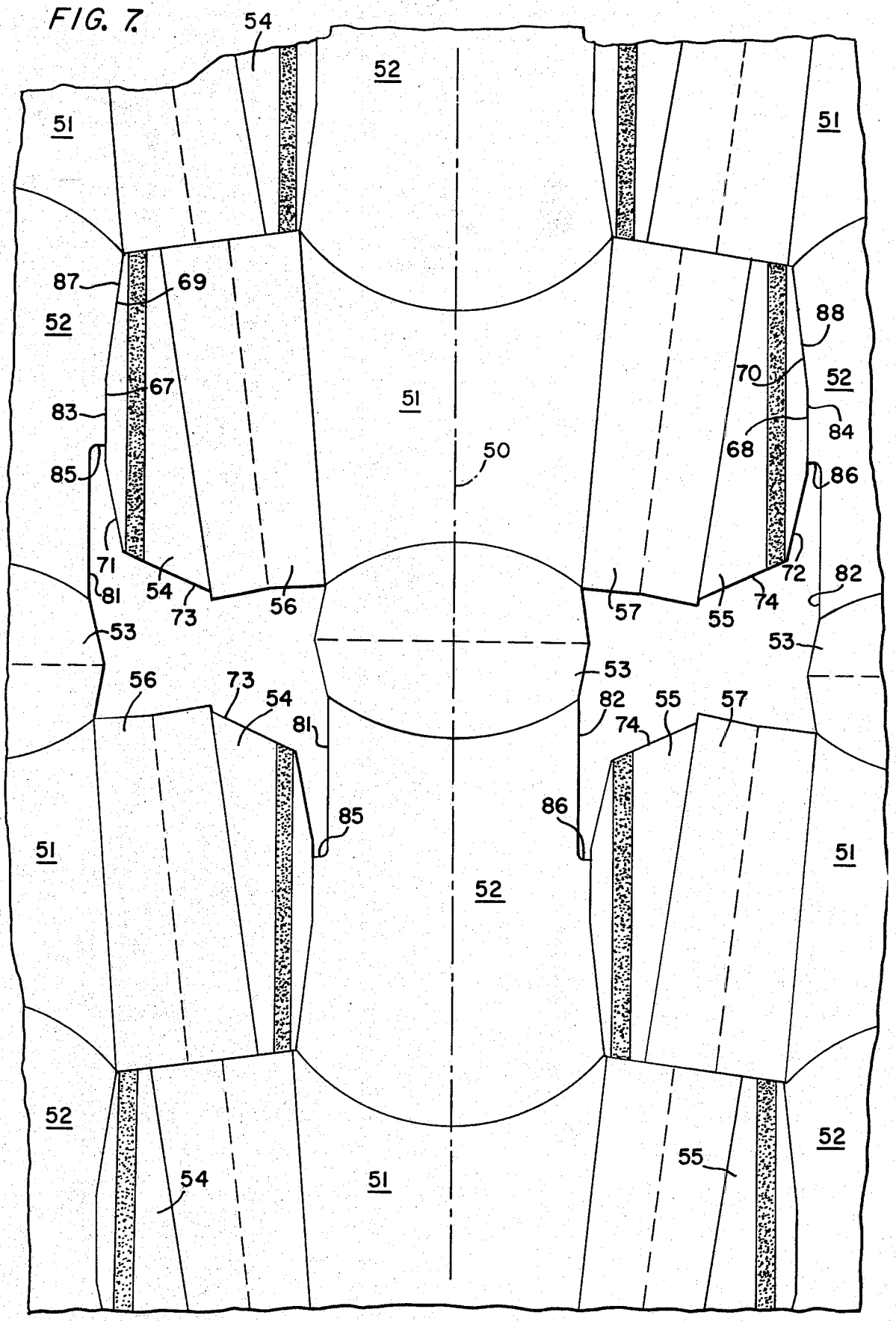
FIG. 7 is an enlarged plan view of a portion of FIG. 6 showing the nested relationship in more detail.

FIGS. 6 and 7 show the preferred layout of the carton blanks of the present invention with FIG. 6 showing a preferred layout on a web of paperboard wherein units of seven carton blanks extend along the width with each unit extending longitudinally of the web for three carton blanks. Normally a web of 43 inches width and infinite length is used but sheets will also work for this layout. Printing that is used on the cartons is done before cutting on roll stock in an in line operation with registration means for the printing and cutting. In general, the manufacture of the carton blanks and cartons involves first the printing on the roll stock. The roll stock is then cut by cutters which might be likened to "cookie cutters" which cut along the edge of the web and center pieces with a single blade cutting edge cutting concave and convex edges which abut on top and bottom of the three row groups. Fingers then remove the scrap. It is then separated into individual cartons and usually piled manually. They are then run through the glue machine folded and ready to be shaped when used. For an example of increased use of the paperboard, with a web and carton of a set size, where 18 cartons were made in prior art carton shapes and layouts, the same paperboard was used to make 21 cartons of the present invention.

FIG. 7 is an enlarged section of the layout of FIG. 6. As can be seen therefrom, the shape of the carton blanks allows abutment not obtainable with any prior cut carton blanks. The scrap pieces cut out by "cookie cutter" type cutters are those bounded by edges of two bottom panels 53, edges of two end wall panels 56, and portions of the edges of two glue flaps 54 and two sidewall panels 52. Alternate scrap pieces are bounded by edges of two bottom panels 53 (opposite side), edges of two end wall panels 57, and portions of the edges of two glue flaps 55 and two sidewall panels 52 (opposite side). The angles of the edges in relation to the center line 50 are such that besides convex edges 89 and concave edges 93 abutting and upper edges (relative to FIG. 5) of end wall panels 56, 57, and glue flaps 54, 55 abutting, there is also abutment of glue flap edges 69 and 70 with sidewall panel edges 87 and 88, respectively, and glue flap edges 67 and 68 with sidewall panel edges 83 and 84, respectively. This has been illustrated for one case by numbering from opposite sides of the same lines in FIG. 7. Such interfitting which differs from layouts of the prior art allows the savings and advantages discussed previously.

The prior art carton blanks cannot just be pushed together so as to abut because the knives will not line up and the angle of the knives cannot be changed because one set must be parallel to the center line for guides in the gluing operation. The parallel knife cannot be recessed into the sidewall panel because that would remove the area on that panel to which the glue flaps are glued. Also, the scrap can not be left attached to that sidewall panel as it would present a bad scrap shape and an impossible knife joint plus an overlapping of paperboard onto a side score causing difficulty in opening the carton.

It will be apparent that modifications in accordance with the present invention can be made by those skilled in the art without departing from the spirit thereof and it is equally apparent that the assembly involving the application of glue and folding of the carton blank may be rearranged in the order of accomplishing these steps without departing from the scope of the invention.

It will be obvious to those skilled in the art that various changes may be made without departing from the scope of the invention and the invention is not to be considered limited to what is shown in the drawings and described in the specification.

What is claimed is:

1. A blank for forming a carton comprising a bottom panel, a pair of sidewall panels each connected to said bottom panel on opposite sides of said bottom panel, end wall panels attached on opposite sides of one of said sidewall panels, glue flaps attached to each of said end wall panels along opposite edges of said end wall panels from the edges of said end wall panels attached to said sidewall panels, a portion of the outer edge of each of said glue flaps aligned parallel to a center line extending longitudinally through said bottom and sidewall panels, a second portion of the outer edge of each of said glue flaps extending inward at an acute angle from said parallel edge portion, the other one of said pair of sidewall panels having an edge portion on each side parallel to the center line extending longitudinally through said bottom and sidewall panels, and outwardly extending edge portions on each side of said sidewall panel extending at an obtuse angle from each of said parallel sidewall edge portions which obtuse angle is complementary to said acute angle of each of said second portions of the outer edges of said glue flaps.

2. The blank of claim 1, further characterized by said sidewall panels having outer edges on their sides opposite from their attachment to said bottom panel which are complementary to each other.

3. The blank of claim 1, further characterized by the other one of said pair of sidewall panels having an indented edge portion on each side parallel to the aforesaid center line and indented from said aforementioned parallel sidewall edge portion on the same side of the said sidewall.

4. The blank of claim 1, further characterized by the grain in the material of the blank running in the direction parallel to said center line.

5. A layout for the knife blade cutting of a plurality of interfitting carton blanks into sheets of several carton blanks and the cutting into individual carton blanks, with each of the carton blanks having a center line running substantially longitudinally of the carton blank comprising edge portions of the carton blanks extending parallel to said center lines, complementary edge portions also parallel to said center lines and complementarily interfitting with said first mentioned parallel edge portion, the sum of the distance from the center line to an edge portion and the center line and an adjacent complementary edge portion being equal to the distance between center lines of adjacent carton blanks on the layout, edge portions sloping inward toward the center line of the cartons from said first mentioned parallel edge portions, complementary edge portions sloping outward from the center line of the cartons from said complementary parallel edge portions at an angle complementary to the angle of the inward slope of said inward sloping edge portions, a plurality of carton blanks comprising the layout, each of said carton blanks including a bottom panel, a pair of sidewall panels each connected to said bottom panel on opposite sides of said bottom panel, end wall panels attached on opposite sides of one of said sidewall panels, glue flaps attached to each of said end wall panels along opposite edges of said end wall panels from the edges of said end wall panels attached to said sidewall panels, a portion of the outer edge of each of said glue flaps aligned parallel to a center line extending longitudinally through said bottom and sidewall panels, a second portion of the outer edge of each of said glue flaps extending inward at an acute angle from said parallel edge portion, the other one of said pair of sidewall panels having an edge portion on each side parallel to the center line extending longitudinally through said bottom and sidewall panels, and outwardly extending edge portions on each side of said sidewall panel extending at an obtuse angle from each of said parallel sidewall edge portions which obtuse angle is complementary to said acute angle of each of said second portions of the outer edges of said glue flaps, said first mentioned parallel edge portions and said inward sloping edge portions being said parallel outer edge portions of said glue flaps and said inward extending second portions of the outer edges of said glue flaps respectively, said complementary parallel edge portions and said complementary outward sloping edge portions being said parallel edge portions of said sidewall panels and said outwardly extending edge portions of said sidewall panels respectively.

6. The layout of claim 5, further characterized by adjacent edges of said edge portions having space between them equal to the thickness of one cutting knife blade at certain edge portions and more than thickness of two cutting knife blades at the remaining edge portions.

7. The layout of claim 5, further characterized by convergent approaching edges of the individual carton blanks approaching each other as fast converging slanting lines without narrow scrap therebetween whereby the difficulty which may be incurred in removing the scrap and detaching it from the carton blanks is avoided.

8. The layout of claim 7, further characterized by said fast converging slanting lines converge toward each other at an angle therebetween in excess of substantially 45°.

* * * * *